US005833319A

United States Patent [19]

Davis

[11] Patent Number: 5,833,319

[45] Date of Patent: Nov. 10, 1998

[54] BACK CUSHION AND SEAT CUSHION SYSTEM

[76] Inventor: Samuel C. Davis, 3917 Rock Ridge Rd., Birmingham, Ala. 35210

[21] Appl. No.: 813,386

[22] Filed: Mar. 7, 1997

[51] Int. Cl.[6] ..... A47C 7/02

[52] U.S. Cl. ..... 297/452.21; 297/452.23; 297/452.31; 297/452.32

[58] Field of Search ..... 297/452.24, 452.25, 297/452.26, 452.16, 452.17, 452.3, 452.31, 452.32, 452.21, 452.23

[56] References Cited

U.S. PATENT DOCUMENTS

| | | | |
|---|---|---|---|
| 2,384,713 | 9/1945 | Varma | 297/452.26 |
| 3,025,105 | 3/1962 | Nash | 297/452.24 X |
| 3,177,036 | 4/1965 | Halter | 297/452.25 |
| 3,291,530 | 12/1966 | Harrison | 297/452.26 X |
| 3,511,537 | 5/1970 | Ackermann | 297/452.32 X |
| 3,531,157 | 9/1970 | Duckett et al. | 297/452.25 X |
| 3,749,442 | 7/1973 | Berg et al. | 297/452.25 X |
| 4,132,228 | 1/1979 | Green | 5/654 X |
| 4,558,903 | 12/1985 | Takagi | 297/284.11 X |
| 4,824,169 | 4/1989 | Jarrell | 297/452.26 X |
| 4,835,801 | 6/1989 | Walpin et al. | 297/452.32 X |
| 4,883,320 | 11/1989 | Izumida et al. | 297/452.3 X |
| 5,092,655 | 3/1992 | Deegener et al. | 297/452.26 X |
| 5,137,333 | 8/1992 | Chee | 297/452.21 |
| 5,288,135 | 2/1994 | Forcier et al. | 297/452.3 X |
| 5,395,162 | 3/1995 | Jay et al. | 297/452.25 |
| 5,456,519 | 10/1995 | Davis | 297/452.32 X |
| 5,522,106 | 6/1996 | Harrison et al. | 297/452.25 X |
| 5,681,092 | 10/1997 | Hanson et al. | 297/452.23 X |

FOREIGN PATENT DOCUMENTS

| | | | |
|---|---|---|---|
| 405049522 | 3/1993 | Japan | 297/452.23 |
| 367721 | 4/1963 | Switzerland | 297/452.26 |

*Primary Examiner*—Peter M. Cuomo
*Assistant Examiner*—David E. Allred

[57] ABSTRACT

A back cushion and seat cushion system including an intermediate extent having a rectangular configuration with an inner edge, an outer edge, and a pair of side edges defining a top face and a bottom face; a back cushion having a top edge, a bottom edge, and a pair of side edges defining a front face and a rear face, the bottom edge of the back cushion being in communication with the intermediate extent, the front face being curved forwardly forming an apex situated at a central extent thereof along a horizontal axis thereby defining an upper tapering portion and a lower tapering portion extending to the top edge and bottom edge of the back cushion, respectively; and a seat cushion having an inner edge, an outer edge, and a pair of side edges defining a top face and a bottom face, the inner edge of the seat cushion being in communication with the intermediate extent, the top face being curved upwardly forming an apex situated between a central extent and the outer edge thereof along a horizontal axis thereby defining an inner tapering portion and an outer tapering portion extending to the inner edge and outer edge of the seat cushion, respectively.

1 Claim, 4 Drawing Sheets

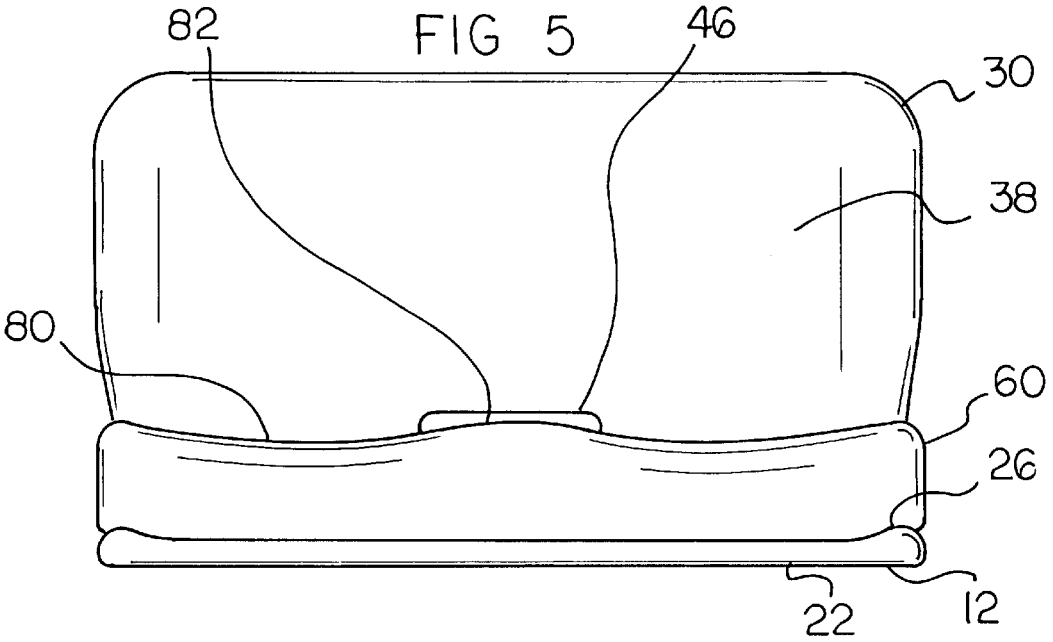
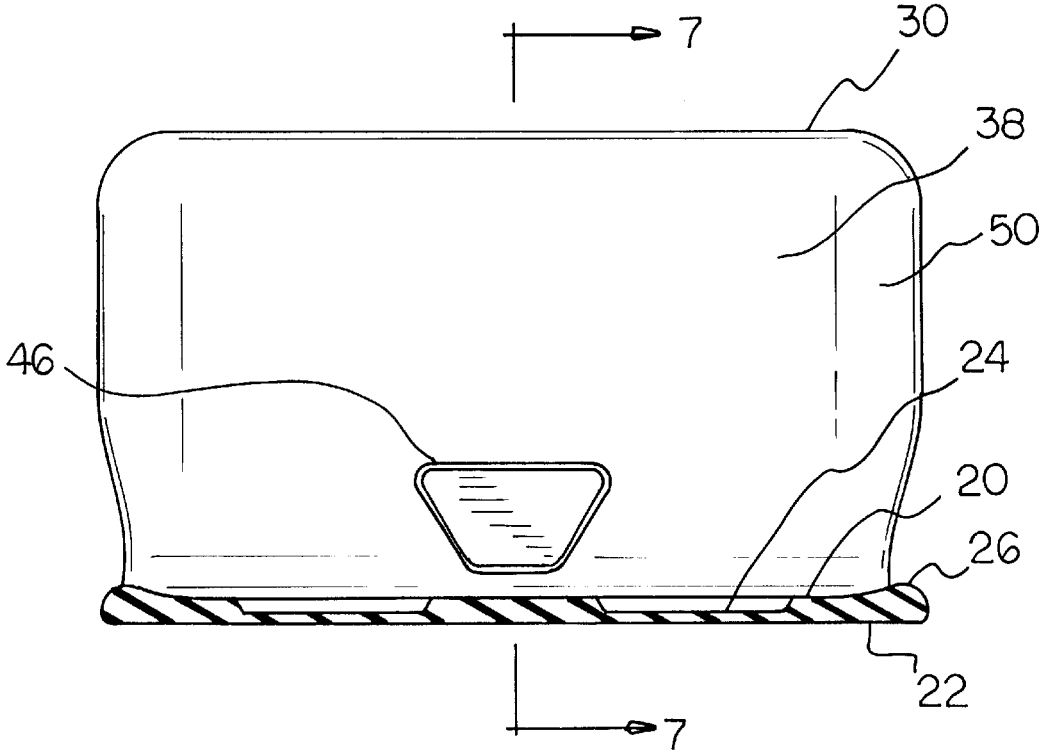
FIG 6

BACK CUSHION AND SEAT CUSHION SYSTEM

BACKGROUND OF THE INVENTION

1. Field of the Invention

The present invention relates to a back cushion and seat cushion system and more particularly pertains to locking a user's sacro-iliac joints whiled in a seated position by means of moments of force applied to the pelvis and femurs of the user.

2. Description of the Prior Art

The use of seat cushions is known in the prior art. More specifically, seat cushions heretofore devised and utilized for the purpose of supporting a user's back and posterior are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,456,519 to Davis which discloses a back and seat cushion system for supporting specific areas of a user's back and posterior to eliminate fatigue and pain in the sacroiliac and lumbar area.

In this respect, the back cushion and seat cushion system according to the present invention substantially departs from the conventional concepts and designs of the prior art, and in so doing provides an apparatus primarily developed for the purpose of locking a user's sacro-iliac joints while in a seated position by means of moments of force applied to the pelvis and femurs of the user.

Therefore, it can be appreciated that there exists a continuing need for a new and improved back cushion and seat cushion system which can be used for locking a user's sacro-iliac joints whiled in a seated position by means of moments of force applied to the pelvis and femurs of the user. In this regard, the present invention substantially fulfills this need.

SUMMARY OF THE INVENTION

In view of the foregoing disadvantages inherent in the known types of seat cushions now present in the prior art, the present invention provides an improved back cushion and seat cushion system. As such, the general purpose of the present invention, which will be described subsequently in greater detail, is to provide a new and improved back cushion and seat cushion system which has all the advantages of the prior art and none of the disadvantages.

To attain this, the present invention essentially comprises an intermediate extent with a rectangular configuration with an inner edge, an outer edge, and a pair of side edges defining a top face and a bottom face. The top face has a pair of ellipsoidal depressions in a side by side relationship so as to define a saddle. The side edges of the intermediate extent have linear bulbous portions extending along an entire length thereof. Such linear bulbous portions extend upwardly with respect to the top face of the intermediate extent. Next provided is a back cushion having a top edge, a bottom edge, and a pair of side edges defining a front face and a rear face. The bottom edge of the back cushion resides in communication with the intermediate extent. The front face is curved forwardly thus forming an apex situated at a central extent thereof along a horizontal axis. Such horizontal axis defines an upper tapering portion and a lower tapering portion extending to the top edge and bottom edge of the back cushion, respectively. For supporting a user's sacrum, the lower tapering portion has an inverted raised trapezoidal sacral counter pressure pad centrally disposed thereon and projected outward therefrom at a location near the bottom edge of the back cushion. The sacral counter pressure pad has a periphery defined by an extended upper edge, a retracted lower edge, and opposed angular side edges extending from the lower edge of the sacral counter pressure pad to the upper edge thereof. Similar to the intermediate extent, the side edges of the back cushion have linear bulbous portions extending along an entire length thereof. As shown in the Figures, the linear bulbous portions extend forwards with respect to the front face of the back cushion. Lastly, a seat cushion is provided having an inner edge, an outer edge, and a pair of side edges defining a top face and a bottom face. The inner edge of the seat cushion is in communication with the intermediate extent. The top face of the seat cushion is curved upwardly forming an apex situated between a central extent and the outer edge thereof. The apex is further extended along a horizontal axis defining an inner tapering portion and an outer tapering portion extending to the inner edge and outer edge of the seat cushion, respectively. The top face of the seat cushion has a semicircular well formed adjacent the inner edge at a central extent thereof for relieving pressure in a user's groin area. The top face further has a pair of spaced troughs with a constant depth with respect to the top face. The linear troughs extend between the inner edge and outer edge of the seat cushion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved back cushion and seat cushion system which has all the advantages of the prior art seat cushions and none of the disadvantages.

It is another object of the present invention to provide a new and improved back cushion and seat cushion system which may be easily and efficiently manufactured and marketed.

It is a further object of the present invention to provide a new and improved back cushion and seat cushion system which is of a durable and reliable construction.

An even further object of the present invention is to provide a new and improved back cushion and seat cushion system which is susceptible of a low cost of manufacture with regard to both materials and labor, and which accordingly is then susceptible of low prices of sale to the consuming public, thereby making such back cushion and seat cushion system economically available to the buying public.

Still yet another object of the present invention is to provide a new and improved back cushion and seat cushion system which provides in the apparatuses and methods of the prior art some of the advantages thereof, while simultaneously overcoming some of the disadvantages normally associated therewith.

Still another object of the present invention is to lock a user's sacro-iliac joints whiled in a seated position by means of moments of force applied to the pelvis and femurs of the user.

Yet another object of the present invention is to support and maintain the lumbar lordosis of a user.

Lastly, it is an object of the present invention to provide a new and improved back cushion and seat cushion systems including an intermediate extent having a rectangular configuration with an inner edge, an outer edge, and a pair of side edges defining a top face and a bottom face; a back cushion having a top edge, a bottom edge, and a pair of side edges defining a front face and a rear face, the bottom edge of the back cushion being in communication with the intermediate extent, the front face being curved forwardly forming an apex situated at a central extent thereof along a horizontal axis thereby defining an upper tapering portion and a lower tapering portion extending to the top edge and bottom edge of the back cushion, respectively; and a seat cushion having an inner edge, an outer edge, and a pair of side edges defining a top face and a bottom face, the inner edge of the seat cushion being in communication with the intermediate extent, the top face being curved upwardly forming an apex situated between a central extent and the outer edge thereof along a horizontal axis thereby defining an inner tapering portion and an outer tapering portion extending to the inner edge and outer edge of the seat cushion, respectively.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view of the present invention.

FIG. 6 is a cross-sectional view of the present invention taken along line 6—6 shown in FIG. 4.

Similar reference characters refer to similar parts throughout the several views of the drawings.

DESCRIPTION OF THE PREFERRED EMBODIMENT

Figure 1:
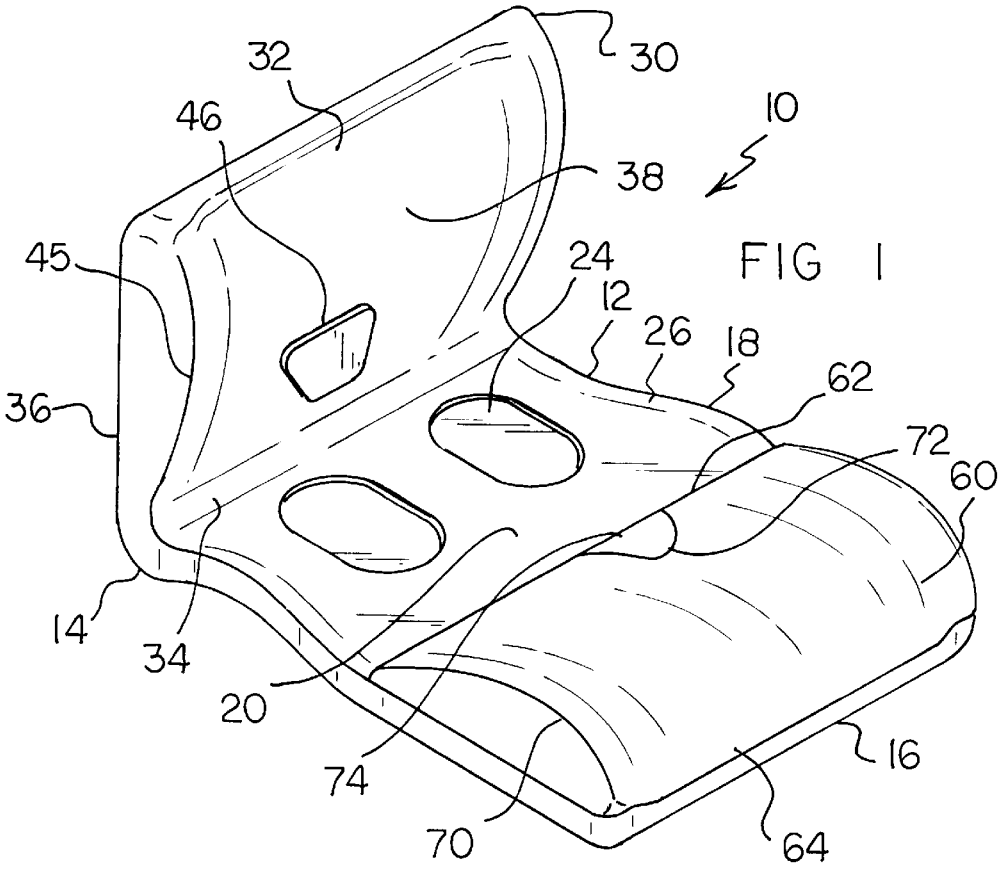
FIG. 1 is a perspective illustration of the preferred embodiment of the back cushion and seat cushion system constructed in accordance with the principles of the present invention.
Figure 2:
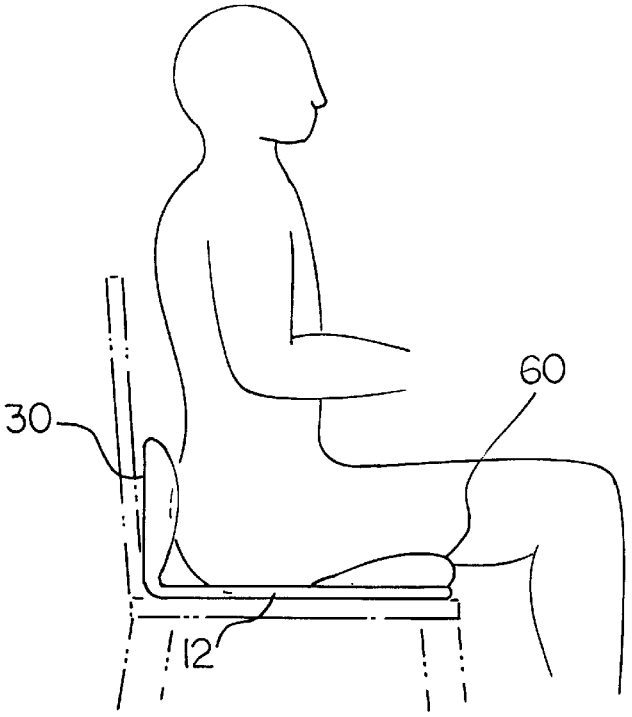
FIG. 2 is a side view of the present invention in use.

With reference now to the drawings, and in particular to FIG. 1 thereof, a new and improved back cushion and seat cushion system embodying the principles and concepts of the present invention and generally designated by the reference numeral 10 will be described.

The present invention, the new and improved back cushion and seat cushion system, is comprised of a plurality of components. Such components in their broadest context include an intermediate extent, a seat cushion, and a back cushion. Such components are individually configured and correlated with respect to each other so as to attain the desired objective.

More specifically, it will be noted that the system 10 of the present invention has an intermediate extent 12 with a rectangular configuration having an inner edge 14, an outer edge 16, and a pair of side edges 18 defining a top face 20 and a bottom face 22. In the preferred embodiment, the intermediate extent has a thickness of approximately 0.5 inches along a majority of its extent. The top face has a pair of ellipsoidal depressions 24 in a side by side relationship so as to define a saddle 25. The ellipsoidal depressions have long parallel side edges that span a length of about 5 inches. The depth of the depressions is preferably a constant 0.125 inches. As best shown in FIGS. 5 & 6, the side edges of the intermediate extent have linear bulbous portions 26 extended along an entire length thereof. Such linear bulbous portions extend upwardly with respect to the top face of the intermediate extent approximately 0.25 inches and have a width of approximately 1 inch.

Next provided is a back cushion 30 having a top edge 32, a bottom edge 34, and a pair of side edges 36 defining a front face 38 and a rear face 40. The bottom edge of the back cushion resides in communication with the intermediate extent. In the preferred embodiment, the bottom edge of the back cushion is integrally coupled with the inner edge of the intermediate extent. Further, the material from which the present invention is constructed allows the back cushion to be bent perpendicular with respect to the intermediate extent along the bottom edge 34 thereof. In an alternate unillustrated embodiment, the intermediate extent has a longer length and is equipped with pile type fasteners situated on the top face thereof. Associated therewith is pile type fasteners situated on the rear face of the back cushion for allowing the back cushion to be releasable coupled to the top face of the intermediate extent thereby affording adjustability in the length of the intermediate extent. Such adjustability affords the benefits of devices like that set forth in U.S. Pat. No. 5,456,519, namely the elevation of the back cushion. Further, in the alternate embodiment, the ellipsoidal depressions are fully extended to the inner edge of the elongated intermediate extent. In use, the back cushion in adapted to support and maintain the lumbar lordosis.

Figure 4:
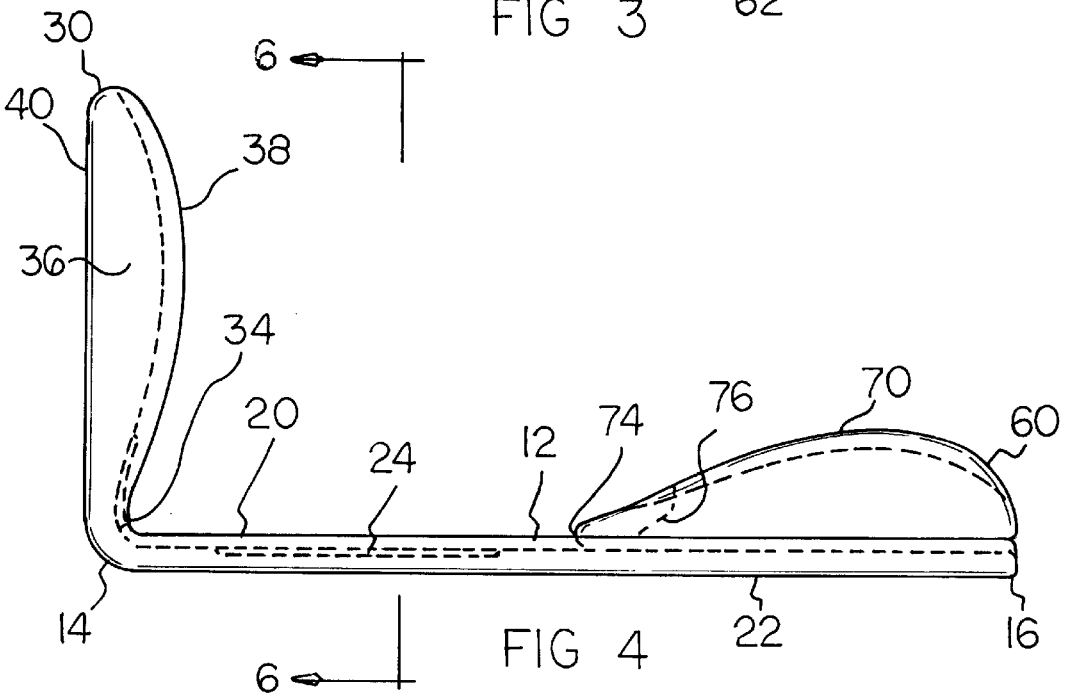
FIG. 4 is a side view of the present invention with phantom lines depicting the contours thereof.
Figure 7:
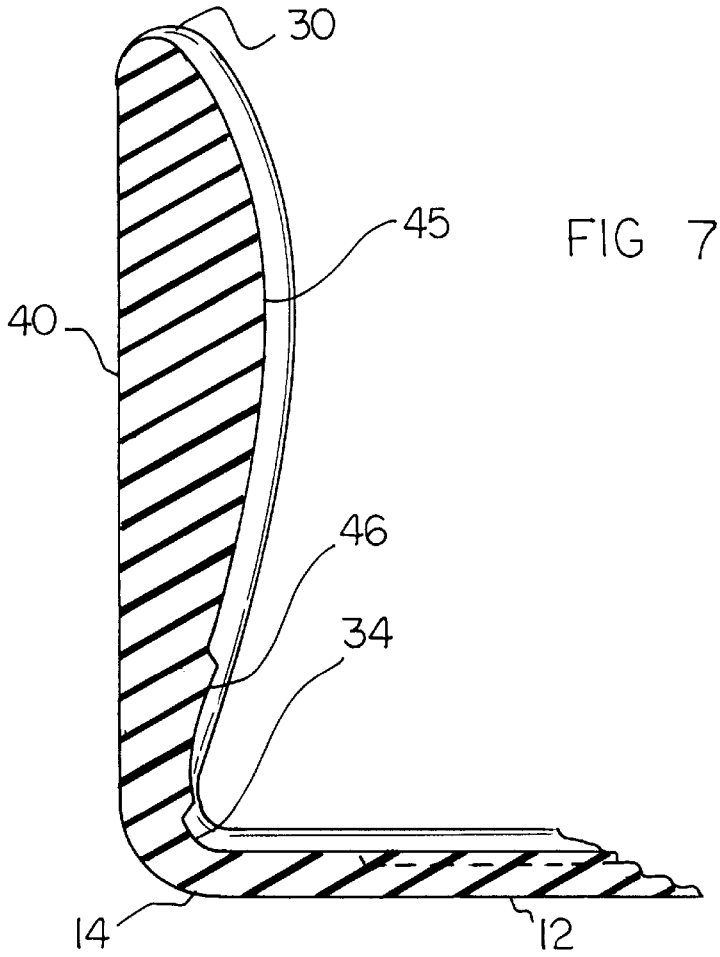
FIG. 7 is a cross-sectional view of the back cushion of the present invention taken along line 7—7 shown in FIG. 7.

As best shown in FIGS. 4 & 7, the front face of the back cushion of the preferred embodiment is curved forwardly thus forming an apex 45 situated at a central extent thereof along a horizontal axis which extends along the entire width of the back cushion. In the preferred embodiment, such apex resides at a distance of 1.5 inches from the rear face of the back cushion. The horizontal axis defines an upper tapering portion and a lower tapering portion extending to the top edge and bottom edge of the back cushion, respectively. The upper and lower tapering portions have a radius of curvature of about 8 inches with such radius being centered about a horizontal axis. The height of the apex 45 is positioned such that it resides at the concave apogee of the lumbar lordotic curve of the user.

For ensuring that a user's sacrum receives gentle counter-pressure, the lower tape-ring portion of the seat cushion has an inverted raised trapezoidal sacral counter pressure pad 46 centrally disposed thereon and projected outward therefrom at a location near the bottom edge of the back cushion. Note FIGS. 1 & 6–8. The sacral counter pressure pad has a periphery defined by an extended upper edge, a retracted lower edge, and opposed angular side edges extending from the lower edge of the sacral counter pressure pad to the upper edge thereof. The angular side edges define a 24 degree angle with respect to a vertical. The sacral counter pressure pad has a top concave surface with an associated radius of curvature of about 8 inches formed about a horizontal axis situated above the front face of the seat cushion and parallel with the top and bottom edges thereof.

Figure 3:
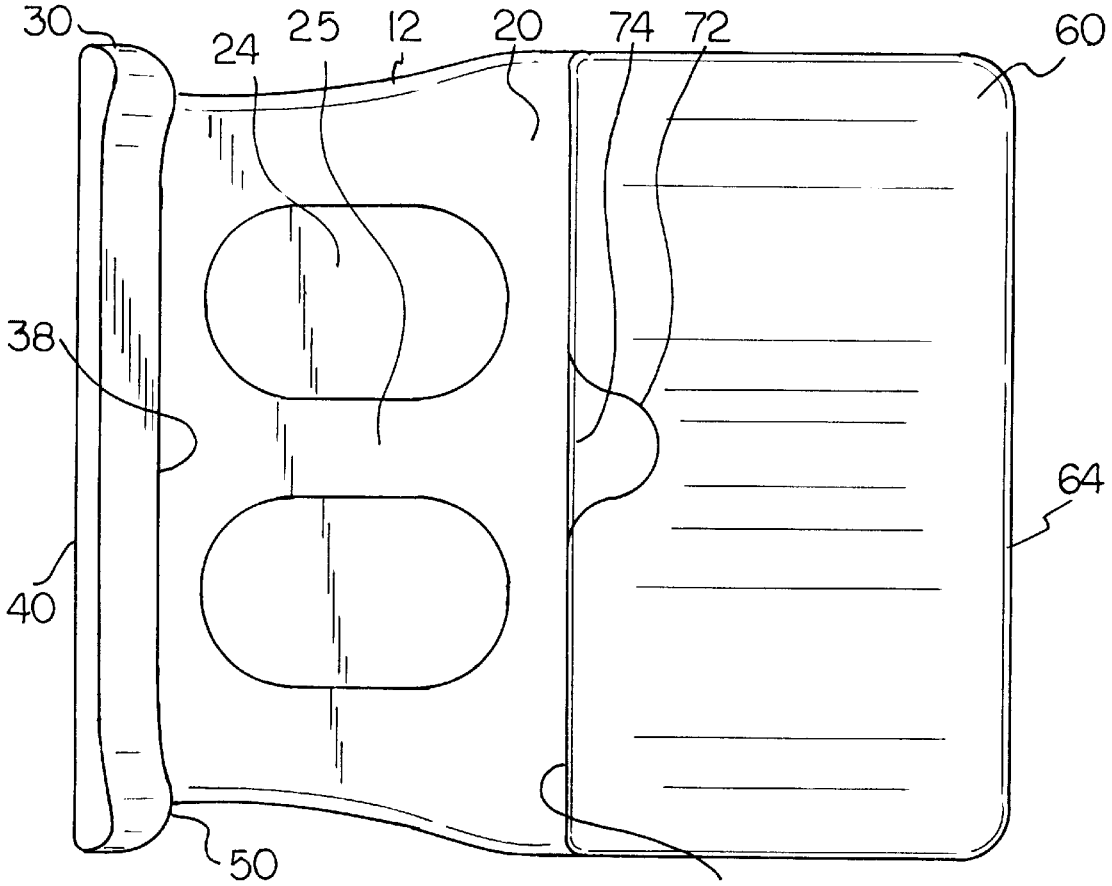
FIG. 3 is a top view of the present invention with the seat cushion attached.

Similar to those of the intermediate extent, the side edges of the back cushion have linear bulbous portions 50 extending along an entire length thereof. Note FIG. 3. The linear bulbous portions extend forward with respect to the front face of the back cushion. It should be noted that the dimensions of the linear bulbous portions of the seat cushion are similar to those of the intermediate extent.

Figure 8:
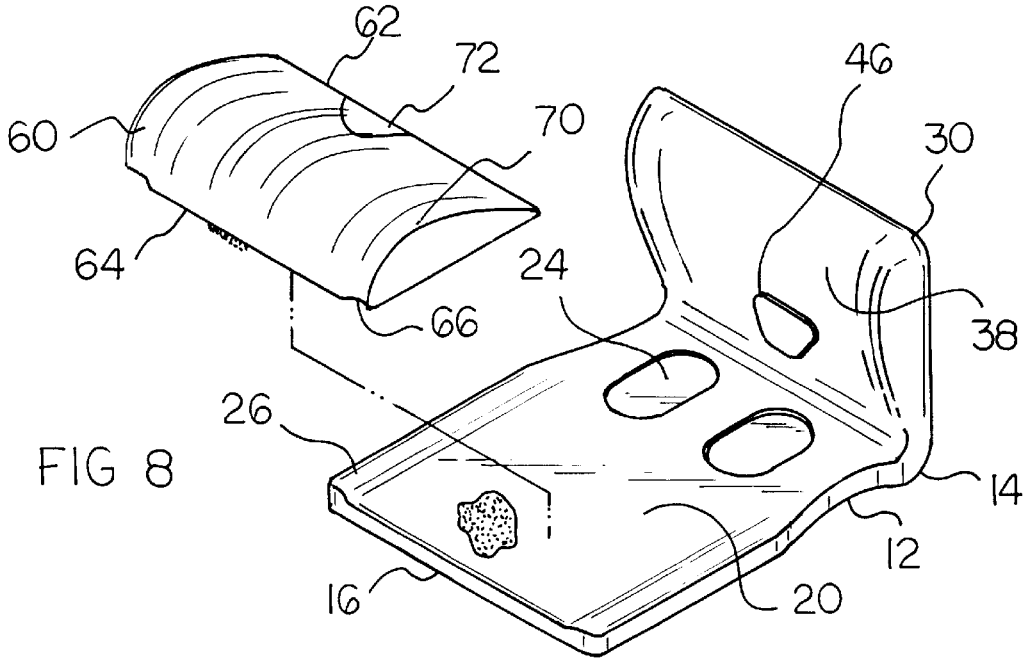
FIG. 8 is an exploded perspective view of the present invention depicting the set cushion in a detached orientation.

Also included is a seat cushion 60 having an inner edge 62, an outer edge 64, and a pair of side edges defining a top face and a bottom face. The inner edge of the seat cushion is in communication with the intermediate extent. In the preferred embodiment, the intermediate extent is elongated with a large space between the ellipsoidal depressions 66 and the outer edge thereof. By this structure, the bottom face of the seat cushion is coupled to the top face of the intermediate extent. As shown in FIGS. 5 & 8, the bottom face of seat cushion has elongated indents formed along the side edges thereof for receiving the linear bulbous portions of the intermediate extent. Further, the preferred embodiment includes pile-type fasteners situated on the top face of the intermediate extent and the bottom face of the seat cushion for providing releasable coupling between the seat cushion and intermediate extent. In the alternate embodiment set forth hereinabove, the seat cushion is integrally coupled to the intermediate extent.

The top face of the seat cushion is curved upwardly forming an apex 70 situated between a central extent and the outer edge thereof. Such apex resides at a distance of about 2.25 inches from the rear face of the seat cushion in the preferred embodiment. The apex is further extended along a horizontal axis defining an inner tapering portion and an outer tapering portion extending to the inner edge and outer edge of the seat cushion, respectively. The top face has a radius of curvature of about 7.5 inches. Further, the top face of the seat cushion has a semi-circular well 72 formed adjacent the inner edge at a central extent thereof for relieving pressure in a male user's groin area. As shown in FIG. 4, the semi-circular well has an inner open extent 74 and an outer extent defined by a tapering wall 76. In the preferred embodiment, the well constitutes less than ¼ the length of the seat cushion.

Finally, the top face of the seat cushion further has a pair of spaced troughs so with a constant depth with respect to the top face. The linear troughs extend between the inner edge and outer edge of the seat cushion. The bottoms of the trough have a radius of curvature of approximately 15.7 inches and reside at a depth of approximately 0.25 inches. Such troughs define a central linear saddle 82 with a radius of curvature of about 6 inches. It should be understood that the horizontal axis of the apex associated with the seat cushion resides at the top of the forgoing seat cushion saddle.

The motivation for developing the present invention is based on the necessity of positioning the sacro-iliac joints while in the seated position. This it done by using moments of force applied to the pelvis and femurs by the unique design of the present invention. The femoral support component is 2–3 inches higher than the area wherein the buttocks are positioned. This creates a posteriorward rotational pelvic force couple, because the pelvic axis of rotation is through the femoral acetabular articulations. This locks the sacro-iliac joints. The aforementioned posterior rotational force tightens the long posterior sacroiliac ligament by this counter-rotational force. Said locking is further enhanced by the lumbar curvature pad since the lumbar vertebrae are stacked vertically on the sacrum and the natural physiological lumbar curve support exerts an anterior moment of force on the lumbar spire. The sum total of these two opposing forces is that which produces the locking of the sacro-iliac joints. As such, there is produced a dynamic stabilization of the sacro-iliac joints, a minimizing of aberrant postural muscular contractions and a secondary vertical physiological repositioning of the thoracic and cervical lordotic curves.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved back cushion and seat cushion system comprising, in combination:

an intermediate extent having a rectangular configuration with an inner edge, an outer edge, and a pair of side edges defining a top face and a bottom face, the top face having a pair of ellipsoidal depressions in a side by side relationship so as to define a saddle, each depression having long parallel side edges that span a length of substantially 5 inches and a constant depth of a constant 0.125 inches, the side edges of the intermediate extent having bulbous portions extending along an entire length thereof, wherein the bulbous portions extend upwardly substantially 0.25 inches with respect to the top face of the intermediate extent and have a width substantially 1 inch;

a back cushion having a top edge, a bottom edge, and a pair of side edges defining a front face and a rear face, the bottom edge of the back cushion being integrally coupled to the intermediate extent and bent in perpendicular relationship therewith, the front face being curved forwardly forming an apex situated along a side-to-side longitudinal horizontal axis defining an upper tapering portion and a lower tapering portion extending to the top edge and the bottom edge of the back cushion, respectively, the lower tapering portion having a trapezoidal sacral counter pressure pad centrally disposed thereon and projected outward therefrom at a location adjacent the bottom edge of the back cushion for supporting a user's sacrum and with the sacral counter pressure pad having a periphery defined by an extended upper edge, a retracted lower edge, and opposed angular side edges extending from the lower edge of the sacral counter pressure pad to the upper edge thereof, the side edges of the back cushion having bulbous portions extending along an entire length thereof, wherein the bulbous portions extend forwards with respect to the front face of the back cushion; and a seat cushion having an inner edge, an outer edge, and a pair of sides edges defining a top face and a bottom face, the inner edge of the seat cushion being removably coupled to the intermediate extent, the top face being curved upwardly forming an apex along a side-to-side horizontal axis defining an inner tapering portion and an outer tapering portion extending to the inner edge and the outer edge of the seat cushion, respectively, the top face of the seat cushion having a semi-circular well formed adjacent the inner edge at a central extent thereof for relieving pressure in a user's groin area, wherein the well has an inner open extent and an outer extent defined by a wall, wherein the well constitutes less than ¼ a length of the seat cushion, the top face further having a pair of spaced troughs with a constant depth with respect to the top face extending between the inner edge and outer edge of the seat cushion.

* * * * *